United States Patent [19]

Khan

[11] 4,259,394

[45] Mar. 31, 1981

[54] PAPERMAKING FABRICS WITH ENHANCED DIMENSIONAL STABILITY

[75] Inventor: Abdul Q. Khan, East Greenbush, N.Y.

[73] Assignee: Huyck Corporation, Wake Forest, N.C.

[21] Appl. No.: 79,222

[22] Filed: Sep. 26, 1979

[51] Int. Cl.[3] ..... B32B 5/02

[52] U.S. Cl. ..... 428/229; 28/110; 28/112; 139/383 A; 162/348; 428/234; 428/257

[58] Field of Search ..... 428/234, 235, 257, 258, 428/259, 253, 233, 245, 300, 224, 373, 225, 229; 28/110, 112; 139/383 A, 425 A, 420 R, 426 R; 156/148; 162/348

[56] References Cited

U.S. PATENT DOCUMENTS

| | | | |
|---|---|---|---|
| 2,313,058 | 3/1943 | Francis | 57/140 |
| 3,839,136 | 10/1974 | Eriksson | 428/234 |
| 4,015,038 | 3/1977 | Romanski et al. | 428/257 |
| 4,119,753 | 10/1978 | Smart | 428/234 |
| 4,143,197 | 3/1979 | Jasionowicz et al. | 428/257 |
| 4,151,323 | 4/1979 | Christie | 428/234 |
| 4,202,382 | 5/1980 | Westhead | 428/257 |

*Primary Examiner*—James J. Bell

*Attorney, Agent, or Firm*—Frost & Jacobs

[57] ABSTRACT

A papermaking fabric composed of a base having a fibrous batt needled to one surface thereof, the base being formed of interwoven core wrapped yarns, comprising core yarns which are effectively heat infusible and wrapping yarns which are effectively heat fusible, the fibrous batt being either heat fusible or heat infusible, the wrapping yarns of the interwoven base being heat fused to each other at their points of contact with each other on the side of the interwoven base opposite the fibrous batt.

10 Claims, 4 Drawing Figures

PAPERMAKING FABRICS WITH ENHANCED DIMENSIONAL STABILITY

BRIEF SUMMARY OF THE INVENTION

This invention relates to papermaking fabrics and has to do more particularly with needled fabrics having enhanced dimensional stability.

The dimensional stability of papermaking fabrics has been a long-standing problem in the industry. While high strength and low elongation have heretofore been used to enhance dimensional stability of the fabrics, such fibers often inhibit or otherwise interfere with the surface characteristics to be imparted to the fabrics, and consequently their use has been a compromise between achieving the desired stability while maintaining the required surface characteristics.

The present invention contemplates the provision of a base fabric which is utilized in conjunction with a needled batt to provide a paper machine felt, the needled fabric being subjected to a fusing operation which stabilizes the fabric and enhances the adhesion of the batt fibers to the base fabric as well as enhancing resistance of the fabric to compaction.

The base fabric is composed of core-wrapped yarns, i.e., a core forming yarn wrapped with one or more layers of wrapping yarn. Essentially the core forming yarns will be heat infusible and the wrap forming yarns heat fusible, the yarns being utilized to produce woven or wrap knitted fabrics. A fibrous batt, which may comprise fusible or infusible fibers, or blends of different types, is needled to one surface of the base fabric, whereupon the fabric is subjected to a heat source so that the fusible wrap yarns on the surface of the fabric opposite the batt will melt and bond at each contact point of the machine direction and cross-machine direction yarns. As a result of the crossover melting and bonding of the wrap yarns, the fused yarn surface becomes smooth and the fabric becomes dimensionally stable in all directions and will resist stretching, wrinkling, distortion or bowing, and the needled batt will be firmly anchored to the base fabric.

The fusible yarns of the base fabric, which may be either staple yarns or multifilaments, will be inherently thermoplastic and will become tacky upon exposure to a temperature close to their melting points and will solidify and become non-tacky upon cooling. The infusible yarns or fibers comprise those which do not melt or become tacky upon heating to a temperature at which the fusible yarns will become tacky. While the temperatures will vary depending upon the particular yarns employed, it will be understood that the term infusible yarns denotes those yarns which are unaffected by heat at temperatures which will result in the fusion of the fusible yarns.

In forming the core wrapped yarns, for which purpose conventional covering or twisting machines may be employed, it is also possible to use two or more types of core yarns selected from both the fusible and infusible classes depending upon the end use property requirements, but in any event at least one component of the core yarn must be of the infusible type. The core may have a single wrap or a plurality of wraps, but the outermost or top wrap must be fusible and the degree of wrap should be such that the entire surface of the core yarn will be substantially covered by the wrap yarn. It is also preferred to use high strength and low shrinkage core yarns in the machine direction, and relatively low shrinkage core yarns in the cross-machine direction to reduce excessive shrinkage and tension during the surface fusing.

The fusing of the base fabric is accomplished by subjecting the exposed surface to a temperature level high enough to melt and fuse at least the top wrap yarns, thus producing a surface-to-surface bond at each crossover point. It has been found that when the fabric is exposed to fusing temperature, preferential surface characteristics are achieved, i.e., the fused surface becomes smooth and incompressible while the unfused surface retains the yarn integrity and is relatively soft and compressible. Fusion can be accomplished by passing the fabric over a suitable heating source, such as an infra red heater, a radient heater, or an open flame, the fusion time being controlled by the speed at which the fabric is advanced.

DETAILED DESCRIPTION

Figure 1:
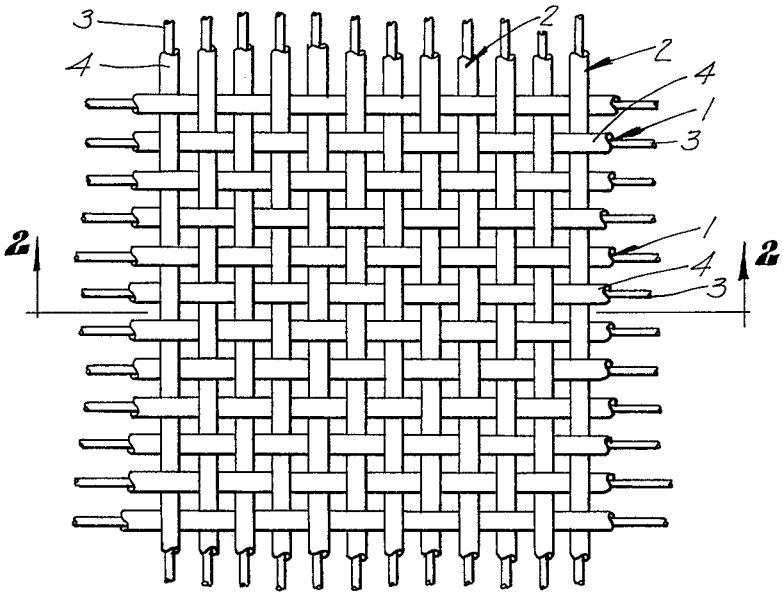
FIG. 1 is a plan view illustrative of a plain weave base fabric in accordance with the invention.
Figure 2:
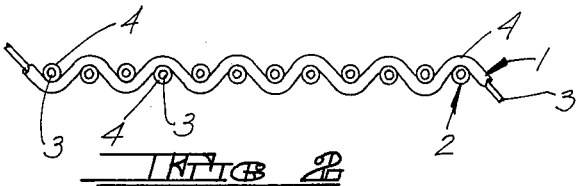
FIG. 2 is a sectional view taken along the line 2—2 of FIG. 1.

A base fabric in accordance with the invention may comprise a woven or wrap knitted fabric, the fabric illustrated in FIG. 1 comprising a plain weave fabric having cross-machine direction yarns 1 and machine direction yarns 2. The yarns 1 and 2 are core wrapped yarns each having a core 3 and an outer wrap 4. The term yarn as used herein contemplates spun yarns and filaments, which may be either monofilament or multifilament.

Basically, two types of yarns are utilized, the first comprising infusible yarns which do not easily melt or become tacky upon heating to relative high temperatures such as approximately 260° C. Examples of yarns of this type are aramid fibers, sold under the trademarks Kevlar and Nomex, homopolymer acrylics, coated Fiberglass, metallic fibers, and Novoloid fibers. The fusible type yarns may comprise polyamide, polyester, olefin, and polyvinyl chloride, which will become fusible at temperatures below those of the infusible yarns.

The core yarns may comprise single or multiple ends of infusible type or combinations of fusible and infusible types, although the major content of the core yarn preferably will be of the infusible type. It may be observed, however, that core yarns consisting wholly of yarns characterized as being of the fusible type also may be employed provided the load bearing machine direction core yarns have a significantly higher melting temperature than the melting temperature of the wrap yarns and the core yarns are not significantly degraded after fusing the warp yarns. For example, a core of polyester or Nylon yarns can be successfully wrpped with polyethelene or polypropylene wrap yarns. It is also preferred to use high strength and low shrinkage core yarns in the machine direction and low shrinkage core yarns in the cross-machine direction to reduce excessive shrinkage and tension during fusion.

The core yarns may have a single wrap or a double wrap of wrapped yarns. If a single wrap is selected, the wrap yarns must be of the fusible type. On the other hand, if the core yarn is double wrapped, then the inner or first wrap may be either fusible or infusible or combination of both types, but the second or outer wrap must be of the fusible type. Preferably, if the core yarn is double wrapped, the inner or first wrap will be in one direction and the second or outer wrap will be in the opposite direction. It is also preferred to use multifilament wrap yarns as the outermost yarns because they achieve a smooth yarn surface after fusion.

Figure 3:
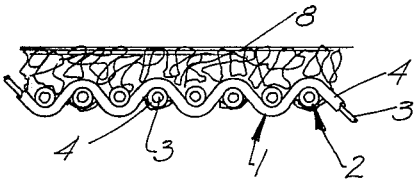
FIG. 3 is a sectional view similar to FIG. 2 illustrating the application of batt fibers to one surface of the base fabric.

Following formation of the base fabric, a fiber batt, indicated at 8 in FIG. 3, is needled onto one surface of the base fabric by a conventional needle punching operation. The batt fibers may be fusible, infusible, or blends of different fibers, depending upon the type of outer wrap yarns used in the base fabric. For example, if the base fabric yarns are wrapped with multifilament polypropylene yarns, the batt fibers may comprise Nylon or polyester which will not be adversely affected when the polypropylene wrapped yarns are fused.

Fusing of the fabric is accomplished by subjecting the surface opposite the batt fiber surface to a temperature sufficiently high to melt and fuse at least the outermost wrap yarns, thereby producing a surface-to-surface bond at each crossover point of the machine direction and cross-machine direction yarns. Where this is done preferential surface characteristics will be achieved in that the fused surface becomes smooth and incompressible while the unfused surface retains the integrity of the wrap yarns and is relatively soft and compressible. At the same time, the needled batt fibers are securely anchored to the base fabric. Press felts fabricated in this manner have excellent dimensional stability, improved batt fiber adhesion to base fabric, improved drainage, less tendency to plug, easy cleanability, and improved resistance to compaction.

Figure 4:
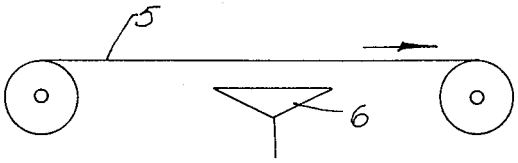
FIG. 4 is a diagrammatic elevational view illustrating heating means for fusing the wrap yarns at their crossover points.

As diagrammatically illustrated in FIG. 4, a fabric 5 formed in accordance with the invention may be advanced in a path of travel over a suitable heat source 6, such as an infra red heater, a radiant heater, or an open flame. Fusing time may be readily controlled by controlling the speed of travel of the fabric. The fabric tension also may be controlled; and time, temperature and tension levels may be varied depending upon the type of wrap yarns which are used. However, the balance of time and temperature should be such that the wrap yarns will melt without excessive flow or degradation of the core yarns due to oxidation. In this connection, where the heat source comprises an infra red heater, an inert gas atmosphere may be utilized to reduce ocidative degradation of the wrap yarns.

Exemplary embodiments of fabrics in accordance with the invention are as follow:

EXAMPLE I

A base fabric having thirty-two ends per inch in the machine direction and twenty-eight picks in the cross-machine direction was woven on a conventional loom using core wrap yarns in a duplex weave pattern. The core wrap yarns in both machine and cross-machine directions were prepared using the following components:

Core: 400 Denier/267 Filaments, Kevlar Aramid Yarn, Type T-964 with O twist.

Outer Wrap Yarn: DuPont Nylon 840 Denier/140 Filament, Type 715.

Inner Wrap Yarn: Allied PET Base Polyester 1000 Denier/192 Filaments, Type 1W72.

The core wrap yarns were prepared on a conventional elastic covering machine in which the innermost wrap was in the "Z" direction and the outer yarn wrap in the "S" direction.

The woven fabric was formed into an endless belt, a fibrous batt of Nomex Aramid fibers of 3" stapel, 5.5 denier was needled to its uppermost surface. Following needling the fabric was mounted between two rotating rolls with a tension of ten pounds per lineal inch applied to the belt. The undersurface of the fabric was fused using an IR heater at a temperature of about 260° C. while maintaining tension, with exposure time controlled by the belt speed. After cooling, the fused fabric surface was smooth and each crossover point was found to be firmly bonded together, resulting in excellent dimensional stability while the unfused needled surface of the fabric retained its fibrous structure and was compressible.

EXAMPLE II

In another embodiment, a core wrap yarn was prepared using the following components:

Core: Three ends of DuPont Nylon 840 Denier/140 Filaments, Type 715.

Inner and Outer Wraps: Two ends of 420 Denier/35 Filament, Twist 0.52, Herculon Olefin Yarn, Type 309. Inner Wrap in "Z" direction and Outer Wrap in "S" direction.

Using the above core wrap yarn in both warp and filling directions, a woven structure was formed into an endless belt; a fibrous batt comprising 50% by weight of 6.0 Denier, 2.5" polypropylene staple and 50% Nylon 6,6 of 6 Denier, 3" staple was needled onto its uppermost surface. The endless belt, mounted between two rotating rolls with a tension of 5 pounds per lineal inch applied to it was subjected to 340° F. temperature. The undersurface of the fabric was fused while maintaining tension, with exposure time controlled by the felt speed.

After cooling, the fused fabric surface was found smooth, batt layer anchored firmly to the base fabric with each crossover point bonded together resulting in excellent dimentional stability.

EXAMPLE III

In another embodiment, a core wrap yarn was prepared using the following components:

Core:

(a) Three Ends of 840 Denier/140 Filament, Nylon 6,6.

(b) Three Ends of 350 Denier/34 Filaments low temperature meltable Nylon Type Grilon K115 (Emser Industries).

Inner and Outer Wrap Yarn: Two Ends of 350 Denier/34 Filaments Grilon K115 Type Nylon. Wrapped in opposite direction using conventional elastic covering machine.

A base fabric structure was woven using the above yarn in both wrap and filling direction. A fibrous batt consisting of blend of Grilon K115, 6 Denier, 2.5" staple fiber and 6 Denier, 3" staple of Nylon 6,6 Type 39N was needled onto both sides of the woven base fabric. A small sample of this structure was subjected to hot air at about 275° F. for several minutes.

After cooling, the batt was found to be firmly anchored to base fabric, the fabric was dimensionally stable with crossover points bonded together.

What is claimed is:

1. A papermaking fabric comprising a base of interwoven machine direction and cross-machine direction core wrapped yarns composed of core forming yarns which are effectively heat infusible and wrap forming yarns which are effectively heat fusible, a fibrous batt needled to one side of said interwoven base, the wrap forming yarns of said interwoven base being heat fused to each other at their points of contact on the side of said interwoven base opposite said fibrous batt.

2. The papermaking fabric claimed in claim 1 wherein said fibrous batt comprises fibers which are essentially heat infusible.

3. The papermaking fabric claimed in claim 1 wherein said fibrous batt comprising fibers which are effectively heat fusible.

4. The papermaking fabric claimed in claim 1 wherein said fibrous batt comprises a mixture of heat fusible and heat infusible fibers.

5. The papermaking fabric claimed in claim 1 wherein the core forming yarns are wrapped with a plurality of layers of wrapping yarns, and wherein the outer layer at least of the wrapping yarns is heat fusible.

6. The papermaking fabric claimed in claim 5 wherein the layers of wrapping yarns are wrapped in opposite directions.

7. The papermaking fabric claimed in claim 6 wherein the inner layer of the wrap forming yarns contains both heat fusible and heat infusible components.

8. The papermaking fabric claimed in claim 1 wherein the interwoven base is composed of load-bearing machine direction yarns and cross-machine direction yarns.

9. The papermaking fabric claimed in claim 1 wherein the interwoven base is composed of load-bearing machine direction yarns and cross-machine direction yarns, and wherein the machine direction core forming yarns at least comprise high strength and low shrinkage yarns.

10. The papermaking fabric claimed in claim 9 wherein the cross-machine direction core yarns also comprise low shrinkage yarns.

* * * * *